US011286645B2

(12) United States Patent
Hiramatsu et al.

(10) Patent No.: US 11,286,645 B2
(45) Date of Patent: Mar. 29, 2022

(54) HYDRAULIC SYSTEM FOR WORKING MACHINE

(71) Applicant: KUBOTA CORPORATION, Osaka (JP)

(72) Inventors: Hisayuki Hiramatsu, Sakai (JP); Kazuaki Shobu, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 16/016,853

(22) Filed: Jun. 25, 2018

(65) Prior Publication Data

US 2019/0003154 A1 Jan. 3, 2019

(30) Foreign Application Priority Data

Jun. 29, 2017 (JP) ..... JP2017-127762

(51) Int. Cl.
*F15B 11/17* (2006.01)
*E02F 9/22* (2006.01)

(52) U.S. Cl.
CPC ..... *E02F 9/2232* (2013.01); *E02F 9/2203* (2013.01); *E02F 9/2292* (2013.01); (Continued)

(58) Field of Classification Search
CPC ..... E02F 9/2239; E02F 9/2242; F15B 11/17
See application file for complete search history.

(56) References Cited

U.S. PATENT DOCUMENTS 4,561,824 A * 12/1985 Okabe ..... E02F 9/2239 414/697
5,083,428 A * 1/1992 Kubomoto ..... F15B 11/17 60/421

(Continued)

FOREIGN PATENT DOCUMENTS

JP 2002-155904 A 5/2002
JP 2002206256 A * 7/2002

(Continued)

OTHER PUBLICATIONS

JP 2002206256 A machine translation to English from espacenet. 2002.*

*Primary Examiner* — F Daniel Lopez
*Assistant Examiner* — Michael Quandt
(74) *Attorney, Agent, or Firm* — Birch, Stewart, Kolasch & Birch, LLP

(57) ABSTRACT

A hydraulic system includes a first hydraulic actuator, a second hydraulic actuator, a first pump to supply operation fluid to the first hydraulic actuator, a second pump to supply operation fluid to the second hydraulic actuator, a second control valve to control operation fluid to be supplied from the second pump to the second hydraulic actuator, and a first control valve including a main control valve to control operation fluid to be supplied from the first pump to the first hydraulic actuator, and a subordinate control valve configured to control operation fluid to be supplied from the second pump to the second control valve and to the first hydraulic actuator. The operation fluid supplied from the second pump is confluent with operation fluid to be supplied from the first pump to the first pump, in a case of activating both of the first hydraulic actuator and the second hydraulic actuator.

9 Claims, 3 Drawing Sheets

(52) U.S. Cl.
CPC ..... *E02F 9/2296* (2013.01); *F15B 11/17* (2013.01); *F15B 2211/30565* (2013.01)

(56) References Cited

U.S. PATENT DOCUMENTS

| | | | | |
|---|---|---|---|---|
| 7,412,826 | B2 * | 8/2008 | Horii | E02F 9/2292 60/421 |
| 9,057,175 | B2 * | 6/2015 | Saotome | E02F 9/2239 |
| 2006/0179691 | A1 | 8/2006 | Kim et al. | |
| 2013/0115035 | A1 | 5/2013 | Saotome | |
| 2014/0366517 | A1 | 12/2014 | Sohn et al. | |
| 2015/0330416 | A1 * | 11/2015 | Kojima | F15B 11/17 60/484 |
| 2017/0037601 | A1 | 2/2017 | Takahashi et al. | |

FOREIGN PATENT DOCUMENTS

| | | | |
|---|---|---|---|
| JP | 2013-100879 | A | 5/2013 |
| JP | 2013-108614 | A | 6/2013 |
| JP | 2014-122654 | A | 7/2014 |
| JP | 2016-133206 | A | 7/2016 |
| KR | 10-2011-0072587 | A | 6/2011 |

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. 2017-127762, filed Jun. 29, 2017. The contents of this application are incorporated herein by reference in their entirety.

FIELD OF THE INVENTION

The present invention relates to a hydraulic system for a working machine.

DISCUSSION OF THE BACKGROUND

A technique disclosed in Japanese Unexamined Patent Application Publication No. 2016-133206 is conventionally known as a working machine having a hydraulic attachment such as a boom, an arm, a bucket, or the like.

The working machine disclosed in Japanese Unexamined Patent Application Publication No. 2016-133206 includes a first circuit to which a boom cylinder, a bucket cylinder, and a left traveling motor belong, a second circuit to which an arm cylinder, and a right traveling motor belong, a third circuit to which a swing motor belongs, a first pump serving as a hydraulic pressure source for the first circuit, a second pump serving as a hydraulic pressure source for the second circuit, and a third pump serving as a hydraulic pressure source for the third circuit, and the working machine supplies the first pump fluid to the bucket cylinder, the second pump fluid to the arm cylinder, the third pump fluid to the boom cylinder when the arm, the bucket, and the arm are operated in combination.

SUMMARY OF THE INVENTION

A hydraulic system for a working machine, includes a first hydraulic actuator to be activated by an operation fluid, a second hydraulic actuator to be activated by the operation fluid, a first pump to supply the operation fluid to the first hydraulic actuator, a second pump to supply the operation fluid to the second hydraulic actuator, a second control valve to control the operation fluid to be supplied from the second pump to the second hydraulic actuator, and a first control valve including a main control valve to control the operation fluid to be supplied from the first pump to the first hydraulic actuator, and a subordinate control valve to control the operation fluid to be supplied from the second pump to the second control valve and to the first hydraulic actuator. The operation fluid supplied from the second pump is confluent with the operation fluid to be supplied from the first pump to the first pump, in a case of activating both of the first hydraulic actuator and the second hydraulic actuator. The operation fluid supplied from the second pump is not confluent with the operation fluid to be supplied from the first pump to the first pump, in a case of inactivating at least one of the first hydraulic actuator and the second hydraulic actuator.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
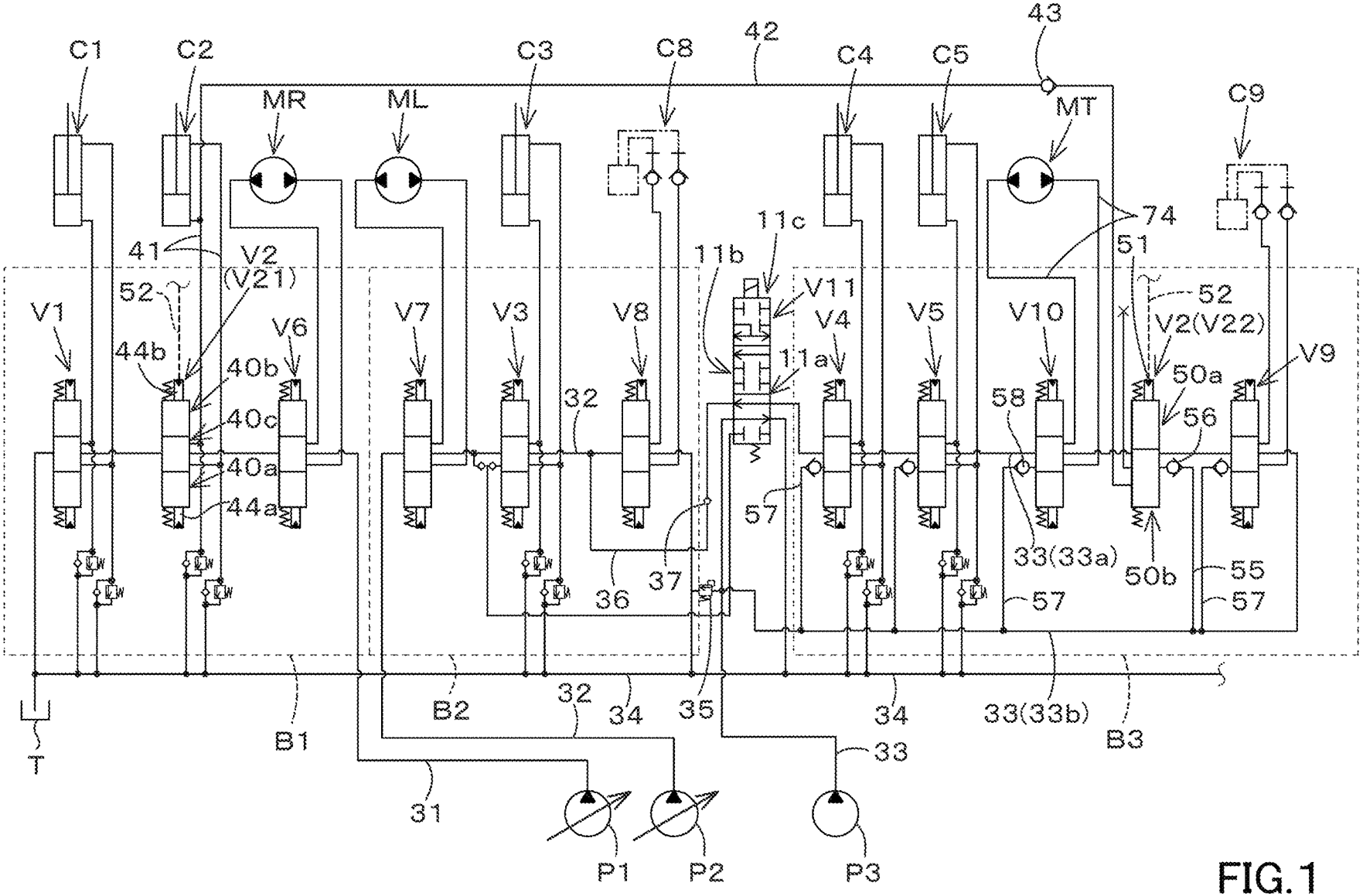
FIG. 1 is a view illustrating a hydraulic system for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Figure 3:
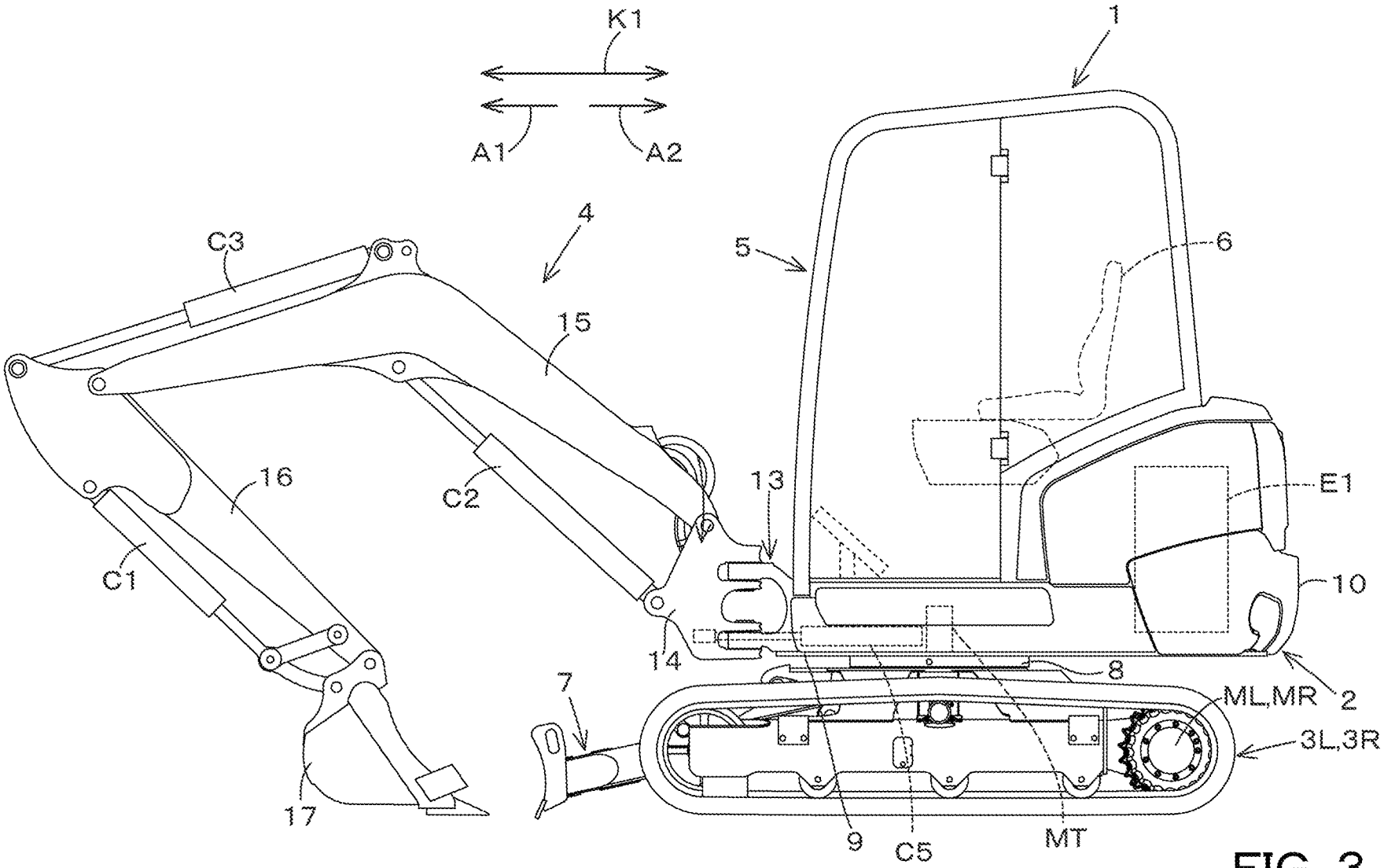
FIG. 3 is a view illustrating an overall side surface of the working machine according to the embodiment.

FIG. 3 is a schematic side view showing an overall configuration of a working machine 1. In the present embodiment, a backhoe is exemplified as the working machine 1. Meanwhile, the working machine 1 may be a front loader, a skid steer loader, a compact track loader, or the like.

At first, the overall configuration of the working machine 1 will be described.

As shown in FIG. 3, the working machine 1 includes a machine body (a turn base) 2, a first traveling device 3R, a second traveling device 3L, and a working device 4. A cabin 5 is mounted on the machine body 2. In a room of the cabin 5, a operator seat (a seat) 6 on which a operator (an operator) is seated is provided.

In the explanation of the present embodiment, the front side of the operator seated on the operator seat 6 of the working machine 1 (the direction indicated by an arrowed line A1 in FIG. 3) is referred to as the front, the rear side of the operator (the direction indicated by an arrowed line A2 in FIG. 3) is referred to as the rear, the left side of the operator (the front surface side of FIG. 3) is referred to as the left, and the right side of the operator (the back surface side of FIG. 3) is referred to as the right. Further in the explanation, the horizontal direction that is a direction orthogonal to the front-to-back direction K1 will be described as the machine width direction.

As shown in FIG. 3, the first traveling device 3R is provided on the right side with respect to the machine body 2, and the second traveling device 3L is provided on the left side with respect to the machine body 2. In the present embodiment, each of the first traveling device 3R and the second traveling device 3L is a crawler type traveling mechanism (a crawler traveling device). The first traveling device 3R and the second traveling device 3L are respectively driven by a traveling motor MR and a traveling motor ML each of which is constituted of a traveling hydraulic actuator. A dozer device 7 is attached to the front portions of the first traveling device 3R and the second traveling device 3L.

The machine body 2 is supported on a traveling frame and is configured to be turned about a longitudinal axis (an axis extending in the upward-downward direction) by a rotation bearing 8. The machine body 2 is pivotally driven by a turn motor MT constituted of a hydraulic motor (a hydraulic actuator). The machine body 2 has a weight 10 and a base plate (hereinafter referred to as a turn base plate) 9 configured to be turned about the longitudinal axis.

The turn base plate 9 is formed of a steel plate or the like, and is connected to the turn bearing 8. The weight 10 is provided on the rear portion of the machine body 2. A prime mover E1 is mounted on the rear portion of the machine body 2. The prime mover E1 is an engine. Meanwhile, the prime mover E1 may be an electric motor or a hybrid type having the engine and the electric motor.

The machine body 2 has a support bracket 13 at the front portion slightly shifting to the right from the center in the machine width direction. A swing bracket 14 is attached to the support bracket 13, and is configured to be swung about the longitudinal axis. A working device 4 is attached to the swing bracket 14.

The working device 4 has a boom 15, an arm 16, and a bucket (a working tool) 17. The base portion of the boom 15 is pivotally attached to the swing bracket 14, and is configured to be turned about a horizontal axis (an axis extending in the machine width direction). In this manner, the boom 15 is configured to be swung up and down. The arm 16 is pivotally attached to the tip end side of the boom 15, and is configured to be turned about the horizontal axis.

In this manlier, the arm 16 is configured to be swung back and forth or up and down. The bucket 17 is provided on the tip end side of the arm 16, and is configured to perform the shoveling operation and the dumping operation. Instead of or in addition to the bucket 17, it is possible for the working machine 1 to mount another working tool (an auxiliary attachment) that is configured to be driven by a hydraulic actuator. Examples of the other working tools (the auxiliary attachments) include a hydraulic breaker, a hydraulic crusher, an angle bloom, a earth auger, a pallet fork, a sweeper, a mower, a snow blower, and the like.

As shown in FIG. 1 and FIG. 3, the first traveling device 3R is configured to travel with use of the traveling motor MR. The second traveling device 3L is configured to travel with use of the traveling motor ML. The dozer device 7 is configured to be moved up and down or tilted by stretching and shortening of the dozer cylinder C4 supported by the machine body 2.

The turn base board 9 is configured to be turned (swiveled) by a turn motor MT provided in the machine body 2. The swing bracket 14 is configured to be swung by the stretching and the shortening of the swing cylinder C5 provided in the machine body 2. The boom 15 is configured to be swung by the stretching and the shortening of the boom cylinder C2. The arm 16 is configured to be swung by the stretching and the shortening of the arm cylinder C3. The bucket 17 is configured to perform the shoveling operation and the dumping operation due to the stretching and the shortening of the bucket cylinder (the working tool cylinder) C1.

The hydraulic actuators for the traveling system such as the traveling motor MR and the traveling motor ML are each constituted of hydraulic motors. The hydraulic actuators for the working such as the bucket cylinder C1, the boom cylinder C2, the arm cylinder C3, and the dozer cylinder C4 are each constituted of hydraulic cylinders. In addition, the hydraulic actuator for the working system such as the turn motor MT is constituted of a hydraulic motor.

FIG. 1 shows a hydraulic system for the working machine 1. The hydraulic system of the working machine 1 includes a first hydraulic pump (a first pump) P1, a second hydraulic pump P2, and a third hydraulic pump (a second pump) P3.

The first hydraulic pump P1 and the second hydraulic pump P2 are each constituted of the hydraulic pumps of variable displacement type (the variable displacement pumps). The third hydraulic pump P3 is constituted of a hydraulic pump of constant displacement type (a constant displacement pump). The first hydraulic pump P1, the second hydraulic pump P2 and the third hydraulic pump P3 are configured to be driven by the power of the engine E1, and to output the operation fluid stored in the operation fluid tank T.

Meanwhile, the hydraulic system for the working machine 1 has a fourth hydraulic pump configured to discharge the operation fluid (the pilot fluid) used for the control, the signal, and the like.

In this embodiment, the first hydraulic pump P1 is configured to supply the operation fluid to the bucket cylinder C1, the boom cylinder C2, and the traveling motor MR.

The second hydraulic pump P2 is configured to supply the operation fluid primarily to a first auxiliary hydraulic actuator C8 that is a hydraulic actuator for operating the traveling motor ML, the arm cylinder C3, and the auxiliary attachment.

The third hydraulic pump P3 is configured to supplies the operation fluid mainly to a second auxiliary hydraulic actuator C9 that is a hydraulic actuator for operating the dozer cylinder C4, the swing cylinder C5, the turn motor MT, and the auxiliary attachment.

Additionally in the embodiment, the hydraulic system for the working machine 1 includes three hydraulic pumps (the first hydraulic pump P1, the second hydraulic pump P2, and the third hydraulic pump P3), but the number of pumps is not limited to that.

The hydraulic system for the working machine 1 has a plurality of control valves V1 to V11. The plurality of control valves V1 to V11 each are valves for controlling a flow rate of the hydraulic fluid to be supplied to the hydraulic actuators (the hydraulic actuator of the working system, and the hydraulic actuator of the traveling system), respectively.

The plurality of control valves V1 to V11 are switching valves configured to switch the position of the spool under the agency of the pilot fluid supplied from the fourth hydraulic pump P4. For example, the pilot fluid is supplied to the plurality of control valves V1 to V11 through the operation valves (the remote control valves) whose opening aperture varies in accordance with the operation of the operation device, and the control valves V1 to V11 are switched by a pressure of the pilot fluid (the pilot pressure).

It should be noted that the configurations of the control valves V1 to V11 are not limited to the configuration to be switched by the pilot pressure. However, the configurations of the control valves V1 to V11 may be constituted of solenoid valves or the like that is electromagnetically operated on the basis of the detection result of the operation amount with respect to the control device.

The plurality of control valves V1 to V10 include a bucket control valve V1 for controlling the bucket cylinder C1, a boom control valve V2 for controlling the boom cylinder C2, an arm control valve V3 for controlling the arm cylinder C3, a dozer control valve V4 for controlling the dozer cylinder C4, a swing control valve V5 for controlling the swing cylinder C5, a right traveling control valve V6 for controlling the traveling motor MR, a left traveling control valve V7 for controlling the traveling motor ML, a first auxiliary hydraulic control valve V8 for controlling the first auxiliary hydraulic actuator C8, a second auxiliary control valve V9 for controlling the second auxiliary hydraulic actuator C9, and a turn control valve V10 for controlling the turn motor MT.

The bucket control valve V1, the boom control valve V2, and the right traveling control valve V6 are connected to a first output fluid tube 31 that is connected to the first hydraulic pump P1. A second output fluid tube 32 connected to the second hydraulic pump P2 is connected to the left traveling control valve V7, the arm control valve V3, and the first auxiliary control valve V8. The third output fluid tube 33 connected to the third hydraulic pump P3 is connected to the dozer control valve V4, the swing control valve V5, the turn control valve V10, and the second auxiliary control valve V9.

Hereinafter, for convenience of the explanation, the block including the bucket control valve V1, the boom control valve V2, and the right traveling control valve V6 is referred to as a first block B1, the block including the left traveling control valve V7, the arm control valve V3, and the first auxiliary control valve V8 is referred to as a second block B2, and the block including the dozer control valve V4, the swing control valve V5, the turn control valve V10, and the second auxiliary control valve V9 is referred to as a third block B3.

Between the second block B2 and the third block B3, a communication valve V11 is provided. The communication valve V11 is a three-position switching valve configured to be switched between a first position 11*a*, the second position 11*b*, and the third position 11*c*.

In the case where the communication valve V11 is in the first position 11*a* or the second position 11*b*, the communication valve V11 connects (communicates) the second output fluid tube 32 and the third output fluid tube 33 with each other. Here, in the case where the communication valve V11 is in the first position 11*a*, the operation fluid outputted from the third hydraulic pump P3 is discharged to the hydraulic fluid tank T through the communication valve V11 and the output fluid tube 34, and thus the operation fluid is in the state where a pressure is not generated in (the operation fluid is not supplied to) the section 33*a* provided from the dozer control valve V4 to the second auxiliary control valve V9, the section 33*a* being included in the third output fluid tube 33 of the third block B3.

Meanwhile, since the check valve 37 is provided in the fluid tube 36 connecting the communication valve V11 and the second output fluid tube 32 with each other, the operation fluid is blocked by the check valve 37 from being supplied from the second output fluid tube 32 to the third output fluid tube 33 (33*a*).

In the case where the communication valve V11 is in the second position 11*b*, the hydraulic fluid outputted from the third hydraulic pump P3 is blocked by the communication valve V11, and in the third output fluid tube 33 of the third block B3, the operation fluid is in the state where a pressure is generated in the section 33*b* provided from the second auxiliary control valve V9 to the relief valve 35, the section 33*b* being included in the third output fluid tube 33 of the third block B3, and thus the operation fluid is supplied to the section 33*a*. In the case where the communication valve V11 is in the third position 11*c*, the communication valve V11 blocks the communication between the second output fluid tube 32 and the third output fluid tube 33.

The boom control valve (the first control valve) V2 configured to control the boom cylinder C2 includes a main control valve V21 provided in the first block B1 and a subordinate control valve V22 provided in the third block B3. The boom cylinder C2 and the main control valve V21 are connected with each other by the main fluid tube 41.

The bottom side of the boom cylinder C2 is connected to the main fluid tube 41 and to the branched fluid tube 42, and the branched fluid tube 42 is connected to the subordinate control valve V22. The branched fluid tube 42 is provided with a first check valve 43 configured to allow the operation fluid to be supplied from the subordinate control valve V22 to the main control valve V21 and to block the operation fluid from being supplied from the main control valve V21 to the subordinate control valve V22.

The main control valve V21 is a three-position switching valve configured to be switched between a first position 40*b*, a second position 40*a*, and a third position (a neutral position) 40*c*. The main control valve V21 has main pressure receiving portions 44*a* and 44*b* to which the pilot pressure is applied.

When the pilot pressure is applied to the main pressure receiving portion 44*b* of the main control valve V21, the main control valve V21 is switched to the first position 40*b*, the hydraulic fluid in the first output fluid tube 31 passes through the main control valve V21 and the main fluid tube 41 and is supplied to the bottom side of the boom cylinder C2, and thereby the boom cylinder C2 is stretched to move (rise) the boom 15 upward.

When the pilot pressure is applied to the main pressure receiving portion 44*a* of the main control valve V21, the main control valve V21 is switched to the second position 40*a*, the hydraulic fluid in the first output fluid tube 31 passes through the main control valve V21 and the main fluid tube 41 and is supplied to the rod side of the boom cylinder C2, and thereby the boom cylinder C2 is shortened to move (lower) the boom 15 downward.

The operation fluid (the pilot fluid) supplied from the fourth hydraulic pump P4 is applied to the main pressure receiving portions 44*a* and 44*b* when the operation device provided in the vicinity of the operator seat 6 is operated.

The subordinate control valve V22 is connected to a supply fluid tube 55 branched from the third output fluid tube 33 (the section 33*b*). The supply fluid tube 55 is provided with a second check valve 56 configured to allow the hydraulic fluid to flow from the section 33*b* side toward the subordinate control valve V22 and to block the hydraulic fluid from flowing from the subordinate control valve V22 side to the section 33*b*.

Meanwhile, in the third block B3, a supply fluid tube 57 branched from the section 33*b* is connected also to the second control valves (the dozer control valve V4, the swing control valve V5, the turn control valve V10, and the second auxiliary control valve V9) other than the subordinate control valve V22, and the third block B3 is a parallel circuit to which the hydraulic fluid is supplied from at least two portions.

The third check valve 58 is connected to each of the supply fluid tubes 57. The third check valve 58 is configured to allow the hydraulic fluid to flow from the second pump side to the second control valve and to block the hydraulic fluid from flowing from the second control valve side to the second pump side.

The subordinate control valve V22 is a two-position switching valve configured to be switched between a first position 50*a* and a second position 50*b*. The subordinate control valve V22 has a subordinate pressure-receiving portion 51 to which a pilot pressure is applied. When the pilot pressure is applied to the subordinate pressure-receiving portion 51 of the subordinate control valve V22, the subordinate control valve V22 is switched to the first position 50*a*, and thus the hydraulic fluid in the third output fluid tube 33 (the supply fluid tube 55*b*) is supplied into the bottom side of the boom cylinder C2 through the subordinate control valve V22 and the branched fluid tube 42.

In this manner, not only the hydraulic fluid from the main control valve V21 but also the hydraulic fluid from the subordinate control valve V22 are applied to the bottom side of the boom cylinder C2, and thus the speed of the upward moving of the boom 15 is increased.

On the other hand, when the pilot pressure stops being applied to the subordinate pressure-receiving portion 51 of the subordinate control valve V22, the subordinate control valve V22 is switched to the second position 50*b*, the hydraulic fluid in the third output fluid tube 33 (the supply fluid tube 55*b*) is not supplied to the branched fluid tube 42, and thus the supply of the hydraulic fluid from the third hydraulic pump P3 to the boom cylinder C2 is stopped.

Meanwhile, an fluid tube (a pilot fluid tube) 52 connected to the main pressure receiving portion 44*b* of the main control valve V21 is connected to the subordinate pressure-receiving portion 51 of the subordinate control valve V22. In this manner, the pilot pressure is applied to the subordinate pressure-receiving portion 51 of the subordinate control valve V22 in accordance with the operation of upward moving of the boom 15.

As described above, since the subordinate control valve V22 supplies the hydraulic fluid to the branched fluid tube 42 at the time of rising operation of the boom cylinder C2 (the first hydraulic actuator), it is possible to increase the rising speed of the boom 15 with a simple configuration.

The main control valve V21 has a main pressure receiving portion 44*b* to which the pilot pressure is applied when the boom cylinder C2 is actuated, and the subordinate control valve V22 has a subordinate pressure-receiving portion 51 to which the pilot pressure applied acting on the main pressure receiving portion 44*b* is applied. In this manner, the subordinate control valve V22 can be quickly switched in accordance with the operation such as the upward moving of the boom cylinder C2, and thus the boom 15 can be raised smoothly and the rising speed of the boom 15 can be increased.

The subordinate control valve V22 is configured to be switched between a first position 50*a* and a second position 50*b*, the first position 50*a* allowing the operation fluid to be supplied to the branched fluid tube 42, the second position 50*b* stopping the operation fluid not to be supplied to the branched fluid tube 42, and the subordinate control valve V22 is configured to be switched to the first position 50*a* when the pilot pressure is applied to the subordinate control valve V22.

According to that configuration, when the subordinate control valve V22 is constituted of a switching valve to be switched between the first position 50*a* and the second position 50*b*, it is possible to quickly supply the operation fluid to the branched fluid tube 42 and to quickly stop the operation fluid not to be supplied to the branched fluid tube 42.

In the embodiment described above, the hydraulic fluid is supplied from the subordinate control valve V22 to the boom cylinder C2 during the rising operation of the boom 15. However, a control valve other than the subordinate control valve V22 in the third block B3, that is, the second hydraulic actuator other than the boom cylinder C2 (the first hydraulic actuator) is operated, and the operation fluid may be supplied from the subordinate control valve V22 to the boom cylinder C2 in the case where the rising operation of the boom 15 is performed.

In the embodiment, in the case where at least one of the turn motor MT (the second hydraulic actuator), the dozer cylinder C4, the swing cylinder C5, and the second auxiliary hydraulic actuator C9 is operated and the rising operation of the boom 15 is performed, the operation fluid is supplied from the subordinate control valve V22 to the boom cylinder C2.

Meanwhile, in the case where a predetermined one or two of the turn motor MT, the dozer cylinder C4, the swing cylinder C5, and the second auxiliary hydraulic actuator C9 are operated and the rising operation of the boom 15 is performed, the subordinate control valve V22 may supply the hydraulic fluid to the boom cylinder C2.

Figure 2:
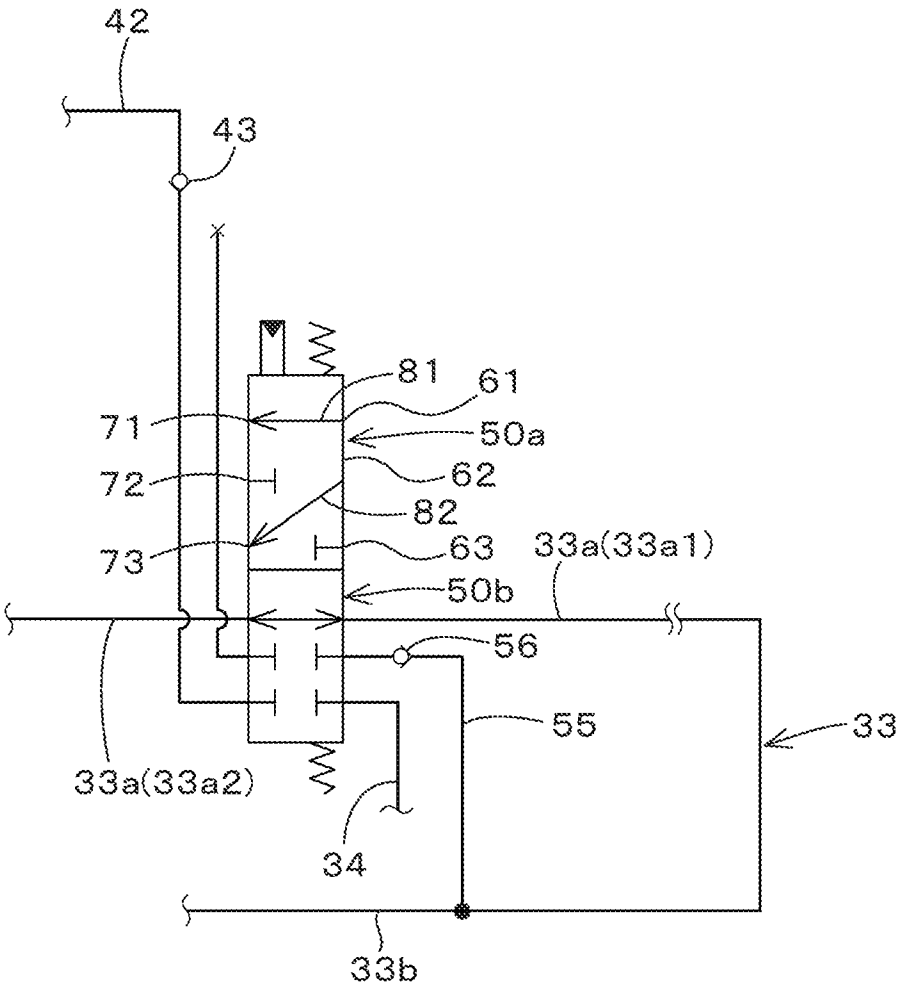
FIG. 2 is a view illustrating details of a subordinate valve disposed on the hydraulic system for the working machine according to the embodiment.

FIG. 2 shows details of the subordinate control valve V22. The structure of the subordinate control valve V22 is not limited to the structure shown in FIG. 2.

As shown in FIG. 2, the subordinate control valve V22 has a first input port 61, a second input port 62, a third input port 63, a first output port 71, a second output port 72, and a third output port 73. An inlet side fluid tube 33*a*1 of the section 33*a* is connected to the first input port 61. A supply fluid tube 55*b* is connected to the second input port 62. An output fluid tube 34 is connected to the third input port 63.

The outlet side fluid tube 33*a*2 of the section 33*a* is connected to the first output port 71. The second output port 72 is designed such that the hydraulic fluid does not flow therein, and is connected to a closing member such as a plug. A branched fluid tube 42 is connected to the third output port 73.

In the case where the subordinate control valve V22 is in the first position 50*a*, the first input port 61 and the first output port 71 are communicated with each other by the internal fluid tube 81. In addition, in the case where the subordinate control valve V22 is in the first position 50*a*, the second input port 62 and the third output port 73 are communicated with each other by the internal fluid tube 82.

Meanwhile, in the case where the subordinate control valve V22 is in the first position 50*a*, the communication between the third input port 63 and the second output port 72 is closed. Since the area of the internal fluid tube 81 and the area of the internal fluid tube 82 are different from each other in the spool (the area of the internal fluid tube 81>> the area of the internal fluid tube 82), and thus a differential pressure is generated.

Here, in the case where the subordinate control valve V22 is in the first position 50*a* and all of the turn motor MT, the dozer cylinder C4, and the swing cylinder C5 each arranged at the downstream side of the subordinate control valve V22 are not operated, the pressure is scarcely generated on the outlet side fluid tube 33*a*2 side (the first output port 71), and thus the hydraulic fluid in the inlet side fluid tube 33*a*1 flows to the outlet side fluid tube 33*a*2 without any resistance.

That is, since the operation fluid in the fluid tube 33*a* of the third output fluid tube 33 smoothly flows to the downstream side through the internal fluid tube 81, the operation fluid in the fluid tube 33*b* does not flow into the branched fluid tube 42 through the supply fluid tube 55 and the inner fluid tube 82 even when the supply fluid tube 55 and the branched fluid tube 42 are communicated with each other.

That is, even when the boom 15 is raised in the case where all of the turn motor MT, the dozer cylinder C4, the swing cylinder C5, and the second auxiliary hydraulic actuator C9 are not operated, the hydraulic fluid from the third hydraulic pump P3 is not supplied to the bottom side of the boom cylinder C2.

On the other hand, in the case where the boom 15 is raised under the state where the subordinate control valve V22 is in the first position 50*a* and at least one of the turn motor MT, the dozer cylinder C4, the swing cylinder C5, and the second auxiliary hydraulic actuator C9 connected in series to the subordinate control valve V22 is operated, the hydraulic fluid from the third hydraulic pump P3 is supplied to the turn motor MT, the dozer cylinder C4, the swing cylinder C5, or the second auxiliary hydraulic actuator C9 through the outlet side fluid tube 33*a*2 side (the first output port 71).

In this manner, the pressure is generated on the outlet side fluid tube 33*a*2 side (the first output port 71) and the pressure of the operation fluid in the inlet side fluid tube 33*a* 1 is increased, thus the operation fluid in the fluid tube 33*b* of the third output fluid tube 33 flows into the supply fluid tube 55, and then the hydraulic fluid entering the supply fluid tube 55 flows to the branched fluid tube 42 through the internal fluid tube 82.

That is, in the case where the main control valve V21 (the boom cylinder C2) is operated in the direction in which the boom 15 moves upward and at least one of the turn motor MT, the dozer cylinder C4, the swing cylinder C5, and the second auxiliary hydraulic actuator C9 is operated, the subordinate control valve V22 supplies the hydraulic fluid to the bottom side of the boom cylinder C2 through the branched fluid tube 42.

Meanwhile, in the case where the subordinate control valve V22 is in the second position 50*a*, the first input port 61 and the first output port 71 are communicated with each other through the internal fluid tube 81. In addition, in the case where the subordinate control valve V22 is in the second position 50*b*, the communication between the second input port 62 and the second output port 72 and the communication between the third input port 63 and the third output port 73 are closed.

In that case, the hydraulic fluid can be supplied to the downstream side from the subordinate control valve V22. Because of the parallel circuit, the hydraulic fluid can be supplied to the downstream side in both of the cases.

According to the embodiment described above, the subordinate control valve V22 supplies the operation fluid to the branched fluid tube 42 when the boom cylinder C2 is raised and at least one of the turn motor MT, the dozer cylinder C4, the swing cylinder C5, and the second auxiliary hydraulic actuator C9 is operated.

Thus, the raising operation of the boom 15 can be accelerated in the case where one or more of the turning operation, the dozer operation, and the swing operation is performed and simultaneously the raising operation of the boom 15 is operated in the working machine 1.

For example, in the case where the turning operation and the raising operation of the boom 15 are operated at the same time, the pressure of the hydraulic fluid at the time of starting the turning becomes higher than a pressure generated in rising the boom 15, and thus the hydraulic fluid from the third hydraulic pump P3 is confluent with the boom cylinder C2 through the subordinate control valve V22 and the branched fluid tube 42.

In this manner, since the boom rising operation can be performed quickly at the time of starting the turning, it is possible to smoothly perform the working such as the loading of the excavated earth and sand onto a transport vehicle such as a truck. Meanwhile, the pressure of the hydraulic fluid on the turning side drops below the pressure of the operation fluid on the boom 15 side in the case where the turning speed becomes constant, and thus the hydraulic fluid from the third hydraulic pump P3 is not confluent with the boom cylinder C2.

In addition, the first hydraulic pump P1 configured to supply the hydraulic fluid to the boom cylinder C2 is a variable displacement pump. And, the third hydraulic pump P3 configured to supply the hydraulic fluid to the turn motor MT, the dozer cylinder C4, the swing cylinder C5, and the second auxiliary hydraulic actuator C is a constant displacement pump.

Thus, in the case where the hydraulic fluid discharged from the third hydraulic pump P3 is supplied to the boom cylinder C2 every time when the boom raising operation is performed regardless of the presence of the turning operation, the dozer operation, the swing operation, and the operation of the second preliminary hydraulic actuator, the load increasing due to the operation of the third hydraulic pump P3 frequently occurs.

Thus, only when at least one of the turn motion, the dozer motion, the swing motion, and the operation of the second preliminary hydraulic actuator is performed and simultaneously the boom 15 is moved upward, the hydraulic fluid discharged from the third hydraulic pump P3 is supplied to the boom cylinder C2 through the branched fluid tube 42, and thereby it is possible to prevent the pump load from becoming unnecessarily high, to improve the heat balance and fuel consumption, and to smoothly perform the rising operation of the boom 15.

Meanwhile, it is to be noted that the branched fluid tube 42 is provided with a first check valve configured to allow the operation fluid to be supplied from the subordinate control valve V22 to the main control valve V21 and to prevent the operation fluid from being supplied from the main control valve V21 to the subordinate control valve V22, and thereby it is possible to smoothly supply the hydraulic fluid to the boom cylinder C2.

In addition, in the embodiment described above, the boom cylinder C2 is described as the first hydraulic actuator. However, the first hydraulic actuator may be a hydraulic actuator other than the boom cylinder C2. In addition, although the boom control valve V2 is described as the first control valve, the first control valve may be a control valve other than the boom control valve V2. In that case, the first hydraulic actuator provided in the working machine 1 can be operated quickly when necessary.

In addition, in the embodiment described above, the turn motor MT, the dozer cylinder C4, the swing cylinder C5, and the second auxiliary hydraulic actuator C9 are described as the second hydraulic actuator. However, the second hydraulic actuator may be another hydraulic actuator. In addition, although the turn control valve V10, the dozer control valve V4, the swing control valve V5, and the second auxiliary control valve V9 are described as the second control valves, the second control valves may be other control valves.

In that case, in the case where the first hydraulic actuator and the second hydraulic actuator are simultaneously operated, the first hydraulic actuator can be operated quickly (only when the pressure of the first hydraulic actuator is lower than the pressure of the second hydraulic actuator).

As described above, in the working machine 1 according to the present embodiment, the operation fluid from the second pump (the third hydraulic pump P3) is confluent with the operation fluid supplied from the first pump (the first hydraulic pump P1) to the first hydraulic actuator in the case where both of the first hydraulic actuator (the boom cylinder C2) and the second hydraulic actuator (any one of the turn motor MT, the dozer cylinder C4, the swing cylinder C5, and the second auxiliary control valve V9) is operated, and the operation fluid from the second pump is not confluent with the operation fluid supplied from the first pump to the first hydraulic actuator in the case where at least one of the first hydraulic actuator and the second hydraulic actuator is not operated.

In this manner, it is possible to quickly operate the first hydraulic actuator in the case where both of the first hydraulic actuator and the second hydraulic actuator are operated. In addition, it is possible to prevent the load of the second pump from unnecessarily increasing when at least one of the first hydraulic actuator and the second hydraulic actuator is not operated, and thereby the heat balance and fuel consumption are improved.

In addition, the subordinate control valve V22 is configured to switched between the first position 50*a* and the second position 50*b*, the first position 50*a* allowing the second pump and the first hydraulic actuator to be communicated with each other and allowing the second pump and the second control valve to be communicated with each other, the second position 50*b* shutting off the communication between the second pump and the hydraulic actuator and allowing the second pump and the second control valve to be communicated with each other.

In this manner, the second hydraulic actuator can be appropriately operated irrespective of the operating state of the first hydraulic actuator.

In addition, the subordinate control valve V22 is switched to the second position in the case where the first hydraulic actuator is operated, and is switched to the first position in the case where the first hydraulic actuator is not operated. The second control valve supplies the operation fluid to the second hydraulic pressure, the operation fluid being supplied from the second pump through the subordinate control valve, in the case where the second hydraulic actuator is operated, and discharges the hydraulic fluid to the hydraulic fluid tank T, the hydraulic fluid being supplied from the second pump through the subordinate control valve, in the case where the second hydraulic actuator is not operated.

In this manner, in the case where the second hydraulic actuator is not operated, the hydraulic fluid supplied from the second pump through the subordinate control valve is discharged to the hydraulic fluid tank T, and thus the hydraulic fluid flows to the hydraulic fluid tank T even in the case where the subordinate control valve V22 is switched to the first position, and thus the hydraulic fluid does not flow to the first hydraulic actuator side.

In this manner, it is possible to realize the hydraulic system, with a simple configuration, in which the hydraulic fluid from the second pump is supplied to the first hydraulic actuator only when both of the first hydraulic actuator and the second hydraulic actuator are operated.

In addition, a plurality of combinations of the second hydraulic actuator and the second control valve (the turn motor MT, the turn control valve V10, the dozer cylinder C4, the dozer control valve V4, the swing cylinder C5, the swing control valve V5) are provided. Each of the second control valves is connected in series to and between the subordinate control valve and the hydraulic fluid tank, supplies the operation fluid to the second hydraulic actuator corresponding to the second control valve, the operation fluid being supplied from the second pump through the subordinate control valve, in the case where the second hydraulic actuator corresponding to the second control valve is operated, and discharges the operation fluid to the other second control valve or to the operation fluid tank connected to the downstream side of the second control valve, the operation fluid being supplied from the second pump through the subordinate control valve, in the case where the second hydraulic actuator corresponding to the second control valve is not operated.

In this manner, it is possible to realize the hydraulic system, with a simple configuration, in which the hydraulic fluid from the second pump is supplied to the first hydraulic actuator only when at least one of the first hydraulic actuator and the second hydraulic actuator is operated.

In addition, the first hydraulic actuator is the boom cylinder C2 configured to performs the rising operation and the lowering operation of the boom 15. And, the subordinate control valve makes the operation fluid from the second pump confluent with the operation fluid supplied from the first pump to the first hydraulic actuator in the case where the boom lifting operation is performed and the second hydraulic actuator is operated, and the subordinate control valve does not make the operation fluid from the second pump confluent with the operation fluid supplied from the first pump to the first hydraulic actuator in the case where the boom lifting operation is not performed and the second hydraulic actuator is not operated.

In this manner, it is possible to realize the hydraulic system, with a simple configuration, in which the hydraulic fluid from the second pump is supplied to the boom cylinder only when the second hydraulic actuator is operated and the boom rising operation is performed.

In addition, the second hydraulic actuator may be the turn motor MT configured to swivel the turn base.

According to the configuration mentioned above, it is possible to realize the hydraulic system, with a simple configuration, in which the hydraulic fluid from the second pump is supplied to the boom cylinder only when the turn motor is operated and the boom rising operation is performed.

The first pump is a variable displacement pump, the second pump is a constant displacement pump, the second pump and the second control valve are connected each other by the supply fluid tube 57 having the third check valve 58, and the third check valve 58 allows the hydraulic fluid to flow from the second pump side to the second control valve and prevents the hydraulic fluid from flowing from the second control valve side to the second pump side.

In addition, the hydraulic system may be configured to include a main fluid tube 41 connecting the main control valve and the first hydraulic actuator with each other, a branched fluid tube 42 connecting the main fluid tube and the subordinate control valve with each other, and a first check valve 43 connected to the branched fluid tube. The first check valve 43 may be configured to allow the operation fluid to be supplied from the subordinate control valve to the main fluid tube and to prevent the operation fluid from being supplied from the main fluid tube to the subordinate control valve.

According to the configuration mentioned above, it is possible to prevent the hydraulic fluid outputted from the first hydraulic pump P1 from affecting the operation of the second hydraulic actuator.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine, comprising:

a first pump to supply an operation fluid to a main control valve through a first output fluid tube;

a second pump to supply the operation fluid to a subordinate control valve through a second output fluid tube;

a first hydraulic actuator connecting to the main control valve through a main fluid tube and connecting to the subordinate control valve through a branched fluid tube;

a second check valve provided in the branched fluid tube; and a second control valve connecting to a second hydraulic actuator, wherein the subordinate control valve includes a first input port connected to the second output fluid tube, a second input port connected to the second output fluid tube through a first check valve which allows fluid communication from the second output fluid tube to the second input port and blocks fluid communication from the second input port to the second output fluid tube, a first output port connected to the second control valve, and a second output port connected to the branched fluid tube, wherein the second output fluid tube is branched into an inlet side fluid tube connecting to the first input port and into a supply fluid tube connecting to the second input port through the first check valve, wherein the subordinate control valve is switched between a first position and a second position, the first position allowing fluid communication between the first input port and the first output port with no throttle in-between and allowing fluid communication between the second input port and the second output port, and the second position allowing the fluid communication between the first input port and first output port with no throttle in-between and blocking the fluid communication between the second input port and the second output port, and wherein the second check valve permits the operation fluid flowing from the subordinate control valve to the main fluid tube and blocks the operation fluid flowing from the main fluid tube to the subordinate control valve.

2. The hydraulic system according to claim 1, wherein the subordinate control valve is arranged upstream the second control valve in the second output fluid tube.

3. The hydraulic system according to claim 1, wherein when the subordinate control valve is switched to the first position and the operation fluid is supplied from the second output fluid tube through the second control valve to the second hydraulic actuator, the operation fluid in the inlet side fluid tube has a pressure increased so that the operation fluid in the second output fluid tube is supplied from the supply fluid tube to the first hydraulic actuator through the first check valve, the second input port, the second output port and the branched fluid tube.

4. The hydraulic system according to claim 1, wherein the second hydraulic actuator is one selected from a group consisting of a turn motor, a swing cylinder, and a dozer cylinder, the second control valve is one selected from a group consisting of a turn control valve to control the operation fluid supplied to the turn motor, a swing control valve to control the operation fluid supplied to the swing cylinder, and a dozer control valve to control the dozer cylinder, and the second control valve is arranged in series with and between the subordinate control valve and an operation fluid tank.

5. The hydraulic system according to claim 1, wherein the first hydraulic actuator is a boom cylinder to move a boom of the working machine upward and downward, and the subordinate control valve supplies the operation fluid from the second pump through the branched fluid tube to the boom cylinder together with the operation fluid from the first pump through the main fluid tube to the boom cylinder when moving the boom upward and activating the second hydraulic actuator.

6. The hydraulic system according to claim 1, wherein the second control valve is a turn control valve to control the operation fluid supplied to a turn motor.

7. A working machine, comprising:

the hydraulic system according to claim 1.

8. The hydraulic system according to claim 1, wherein the subordinate control valve is switched to the first position when the first hydraulic actuator is activated, and to the second position when the first hydraulic actuator is not activated, when the first hydraulic actuator is activated while the second hydraulic actuator is activated, the operation fluid from the second pump through the second output fluid tube is supplied through the supply fluid tube, the second input port, the second output port and the branched fluid tube to the main fluid tube so as to be merged with the operation fluid from the first pump to the first hydraulic actuator, and when the first hydraulic actuator is activated while the second hydraulic actuator is not activated, the subordinate control valve is switched to the first position and the operation fluid from the second pump flows to the second control valve through the inlet side fluid tube, the first input port and the first output port, and does not flow to the branched fluid tube so as not to be merged with the operation fluid from the first pump to the first hydraulic actuator.

9. The hydraulic system according to claim 1, wherein the first hydraulic actuator is a boom cylinder to move a boom of the working machine upward and downward, the second hydraulic actuator is a turn motor, the second control valve is a turn control valve to control the operation fluid supplied to the turn motor, the subordinate control valve is switched to the first position when the first hydraulic actuator is activated, and to the second position when the first hydraulic actuator is not activated, when the turn motor is started to be activated while the boom is moved upward, the operation fluid from the second pump through the second output fluid tube is supplied through the supply fluid tube, the second input port, the second output port and the branched fluid tube to the main fluid tube so as to be merged with the operation fluid from the first pump to the boom cylinder, and when the turn motor has a turning speed which becomes constant while the boom is moved upward, a pressure of the operation fluid supplied to the turn motor drops below the operation fluid supplied to the boom cylinder so that the operation fluid from the second pump does not flow to the branched fluid tube through the inlet side fluid tube, the first input port and the first output port, and is not merged with the operation fluid from the first pump to the boom cylinder.

* * * * *